US006752824B2

(12) United States Patent
Yancy

(10) Patent No.: US 6,752,824 B2
(45) Date of Patent: Jun. 22, 2004

(54) READY-TO-USE SENSORY DIVERSION DEVICE

(76) Inventor: Eric A. Yancy, 8140 Morningside Dr., Indianapolis, IN (US) 46240

( * ) Notice: Subject to any disclaimer, the term of this patent is extended or adjusted under 35 U.S.C. 154(b) by 0 days.

(21) Appl. No.: 10/230,551

(22) Filed: Aug. 29, 2002

(65) Prior Publication Data

US 2004/0044367 A1 Mar. 4, 2004

(51) Int. Cl.[7] ..... A61J 17/00
(52) U.S. Cl. ..... 606/234
(58) Field of Search ..... 606/234, 235, 606/236; 215/11.1–11.6

(56) References Cited

U.S. PATENT DOCUMENTS

| | | | | |
|---|---|---|---|---|
| 3,610,248 A | | 10/1971 | Davidson | |
| 3,892,243 A | | 7/1975 | Bell | |
| 3,935,743 A | | 2/1976 | Brodie et al. | |
| 4,192,307 A | | 3/1980 | Baer | |
| 4,488,551 A | | 12/1984 | Connelly | |
| 5,127,903 A | | 7/1992 | Mailot et al. | |
| 5,156,617 A | * | 10/1992 | Reid | 606/234 |
| 5,176,705 A | | 1/1993 | Noble | |
| 5,194,004 A | | 3/1993 | Bergersen | |
| 5,395,392 A | | 3/1995 | Suhonen | |
| 5,728,137 A | * | 3/1998 | Anderson-Fignon | 606/234 |
| 5,993,413 A | | 11/1999 | Aaltonen et al. | |

* cited by examiner

*Primary Examiner*—Kevin T. Truong
(74) *Attorney, Agent, or Firm*—Barnes & Thornburg

(57) ABSTRACT

A ready-to-use, sterile, one time use sensory diversion device is described. The device can be used by medical practitioners during examination and performance of medical procedures on infant and juvenile patients. The device is typically manufactured in the form of a pacifier and includes a sweetener composition, either formed as a coating on the carrier nipple portion or is provided separately for user application to the carrier portion prior to or in conjunction with removal of the device from its sterile package.

18 Claims, 4 Drawing Sheets

READY-TO-USE SENSORY DIVERSION DEVICE

FIELD OF INVENTION

This invention relates to a device for use by medical practitioners. More particularly the invention is directed to a disposable pacifier for the purpose of delivering small amounts of sweetener to infants and/or juveniles for sensory diversion during performance of medical examination/procedures.

BACKGROUND AND SUMMARY OF THE INVENTION

Various clinical investigations have shown that oral administration of a sweetener such as sucrose or sucrose solution to infants, toddlers, and other juvenile patients during medical examination/treatment has a calming effect that allows the physician or nurse to provide more efficient and effective care. One common practice in hospitals and physicians' offices is to keep a container of a sucrose solution in the examining/treatment room. A pacifier is dipped into the sucrose solution and given to the patient. To administer additional "doses," the pacifier is usually dipped back into the same container of sucrose solution and re-administered to the patient. One problem deriving from such usage protocols is patient exposure to bacterial infections. Sucrose solutions provide an excellent medium for bacterial growth and medical treatment facilities inherently provide a multiplicity of sources for bacterial contamination of the sucrose solution and the pacifier used to deliver it to young patients.

According to the present invention there is provided a ready-to-use, single-use pacification device for safe and convenient oral delivery of sweeteners to infant or juvenile recipients. The apparatus comprises a pacifier including a flexible sweetener carrier portion for insertion into the patient's mouth, a handle portion and a safety flange between the handle portion and the carrier portion. In preferred embodiments at least the flexible carrier portion of the pacifier is sealed in a sterile package with a sterile composition comprising a sweetener for coating the carrier portion. In one embodiment the sweetener composition is in a separate user-disruptible package preferably positioned within the sterile package enclosing at least the carrier portion of the pacifier device. The carrier portion is optimally configured to have enhanced surface area to improve its sweetener-carrier function. In one embodiment a user-disruptible package of a sweetener solution or gel is positioned within a sterile package containing at least the carrier portion of the device. The device can be used by the medical practitioner simply by first disrupting the package comprising the sweetener composition and manipulating the sterile package to coat the carrier portion of the pacifier which is then removed from the sterile package immediately prior to patient administration.

Additional features of the invention will become apparent to those skilled in the art upon consideration of the following detailed description of the preferred embodiments exemplified in the best mode of carrying out the invention as presently perceived.

DETAILED DESCRIPTION OF THE PREFERRED EMBODIMENTS

The present invention provides a safe and convenient sensory diversion device for use by medical practitioners during their examination and performance of medical procedures on infants and/or juveniles. More particularly, the invention provides a ready-to-use pacification device for oral delivery of sweeteners to infant or juvenile patients. The device in its preferred form is a pacifier including a flexible sweetener carrier portion, a handle portion and a safety flange between the handle portion and the carrier portion. At least the carrier portion of the pacifier is sterilized and sealed in a sterile package with a sterile with a sterile sweetener composition either pre-applied to the carrier portion or available for sterile application to the carrier portion. The device is either manufactured under sterile conditions or it is sterilized post-manufacture or post-packaging by exposure to sterilizing gasses or actinic radiation. In one embodiment the device is manufactured with the sweetener composition formed as a coating on the delivery/carrier portion, packaged and thereafter subjected to sterilization. In another embodiment the pacifier device is manufactured and packaged in a sealed container having flexible sidewalls with a liquid or gel-like sweetener composition in a user breachable package. Each of the components can be sterilized before packaging or the final packaged product can be sterilized post-packaging using, for example, gamma radiation.

In still another embodiment of the invention the pacifier device is manufactured and at least the flexible portion of the pacifier is sealed in a container with a sweetener either pre-applied or positioned for user application to the carrier portion immediately before use. The present sensory diversion device is utilized by the medical practitioner simply by removing the sterile device from the sealed package immediately prior to patient administration. The device is intended for disposal following patient use. Thus the present invention provides the medical practitioner with a safe, easy to use, disposable infant/juvenile sensory diversion device.

Figure 1:
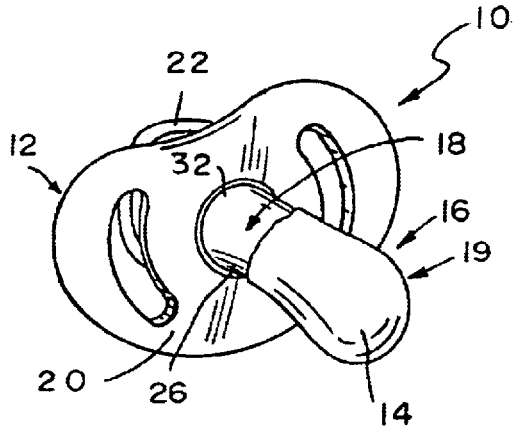
FIG. 1 is a perspective view of a sweetener delivery device for use in accordance with the present invention including a pacifier having a flexible delivery/carrier portion—a nipple, a handle portion, and an intermediate safety flange, and also showing a coating of sweetener on the nipple.
Figure 2:
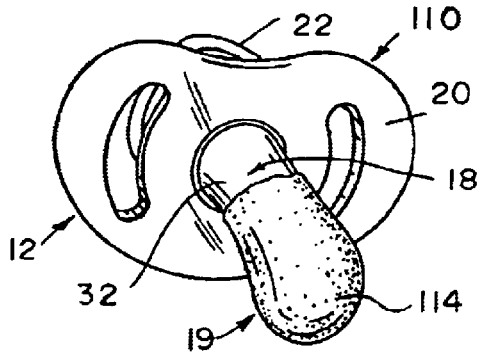
FIG. 2 is a perspective view of another sweetener delivery device illustrating a powder coating on the carrier portion.
Figure 3:
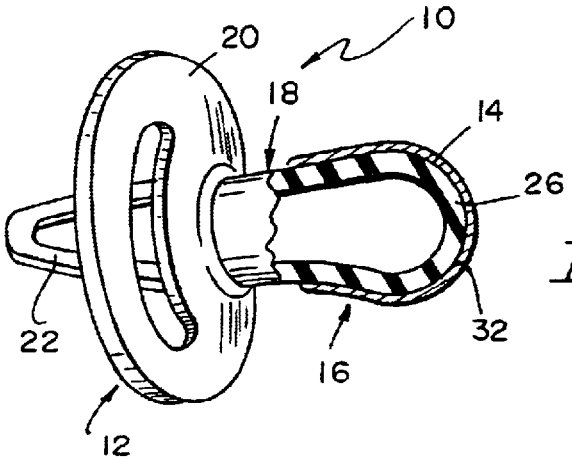
FIG. 3 is a side view of the device illustrated in FIG. 1 with portions broken away.

With reference to the drawings, FIGS. 1 and 2 illustrate a sweetener delivery device 10,110 in accordance with this invention. It is in the form of a pacifier 12 having handle portion 22, a sweetener carrier/delivery portion 16 and a safety flange 20 between the handle portion 22 and carrier portion 16. The carrier portion 16 is in the form of a nipple 18 having a flexible wall 26 and outer surface 32. Sweetener composition 14 is coated onto outer surface 32 of nipple 18. The sweetener composition 14 is applied to nipple 18 during device manufacture as a film-forming thermoplastic or thermosetting composition to provide a sweetener-containing coating which is either saliva soluble or is capable of releasing sweetener into saliva contacting the sweetener coating 14. Alternatively the sweetener coating can be formed on nipple 18 during device manufacture by initially coating at least the terminal portion 19 of nipple 18 with a food-acceptable adhesive composition and thereafter contacting the adhesive-coated terminal portion 19 of nipple 18 with a powdered solid composition comprising a sweetener, either in the form of a powdered sugar, for example sucrose, fructose, or glucose, or an artificial sweetener such as saccharin, in combination with a food-acceptable powdered carrier therefor to form an adherent powdered sweetener coating 114 at least on the terminal portion 19 of nipple 18 (see FIG. 2).

The sweetener composition utilized in forming the sweetener coating 14,114 can be formulated from a wide variety of pharmaceutically acceptable and/or food-acceptable components to provide a nipple adherent, non-friable coating that can either dissolve in saliva during use of the device or is saliva insoluble but capable of releasing taste-detectable amounts of sweetener into saliva that is contacted with the coated nipple 18 component of the device during device use. Sweeteners can include both caloric and/or non-caloric sweeteners, and such sweeteners can be combined with starches, gums, gelatins and the like to provide functional coating compositions for preparing the sensory diversion devices in accordance with the invention.

Preferably the sweetener compositions and the device itself should be prepared under sterile conditions or at least under clean conditions to ensure that post-manufacture sterilization processing is effective to sterilize the device either before or after final packaging. In one embodiment of the invention a sensory diversion device 10,110 is manufactured and sealed into a user-breachable package 40 comprising any art-acceptable packaging material 24 capable of providing and maintaining a sterile in-package condition during storage, shipment and handling before sale and use. The package is designed to maintain the device in a sterile condition until the device is removed from the package by the end user. The form of, and the materials used in manufacture of, the device package 40 is not critical provided that the materials are selected for their known properties of providing a sterile environment in the package until the package is breached or opened by the end user. Also the package 40 should be designed to allow facile opening of the package and removal of the sterile device 10 immediately prior to use. Thus, for example, with reference to FIG. 4, the package can be designed to have pre-cut tear notches 39 to facilitate user breach of package 40 to removed sterilized pacifier 12 having nipple 18 with sweetener coating 14.

Figure 4:
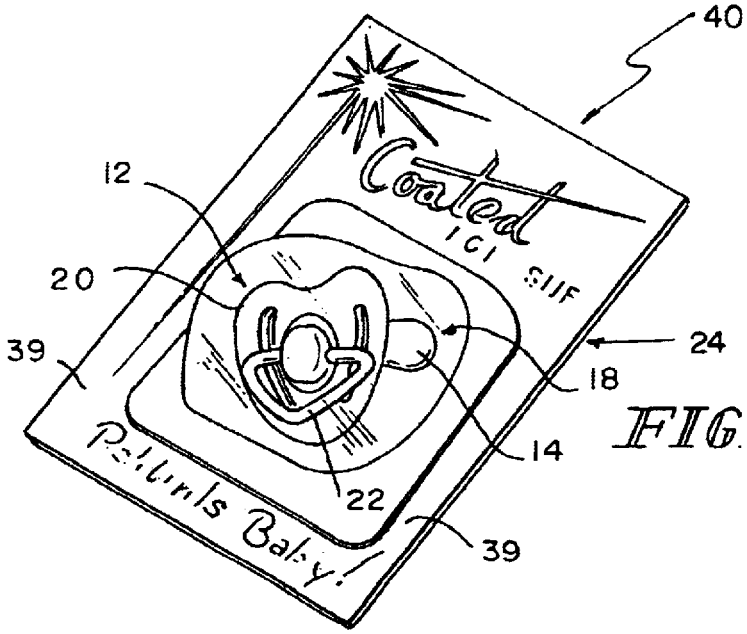
FIG. 4 is a perspective view showing the sweetener delivery device of FIG. 1 packaged in a sterile container.
Figure 9:
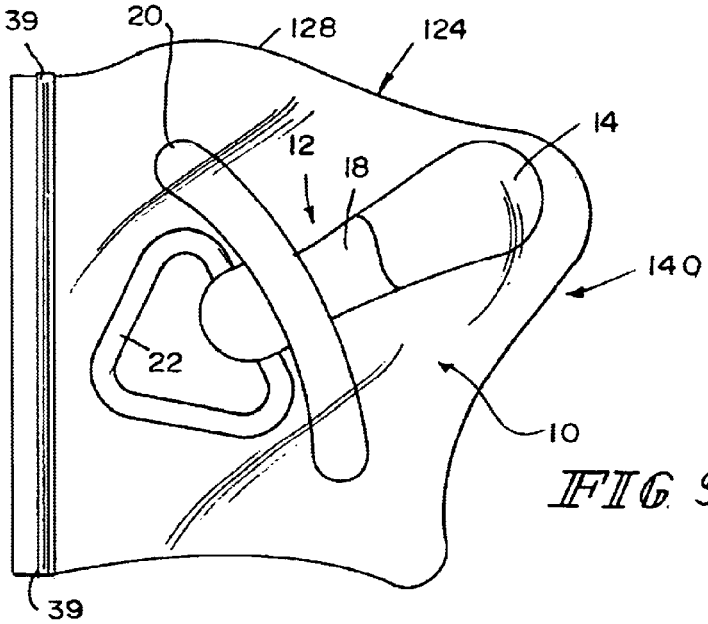
FIG. 9 illustrates a sweetener delivery device of the present invention in a sterile, user-breachable package.

FIG. 9 illustrates another embodiment of the invention similar to that illustrated in FIG. 4 wherein the sensory diversion device 10 is in the form of a pacifier 12 having a handle 22 and nipple 18 with sweetener coating 14 and intermediate safety flange 20. The pacifier 12 is either manufactured and packaged in an envelope 128 of a packaging material 124 providing a sterilization-maintaining barrier for package 140 which is provided with pre-cut tear notches 39 to facilitate user breach of the package and removal of the ready-to-use sensory diversion device immediately prior to use. Alternatively a manufactured pacifier 12 having nipple 18 with sweetener coating 14 can be packaged into envelope 128 and sealed and thereafter subjected to actinic radiation of a nature and amount sufficient to ensure sterilization of the device and its respective components.

Figure 5:
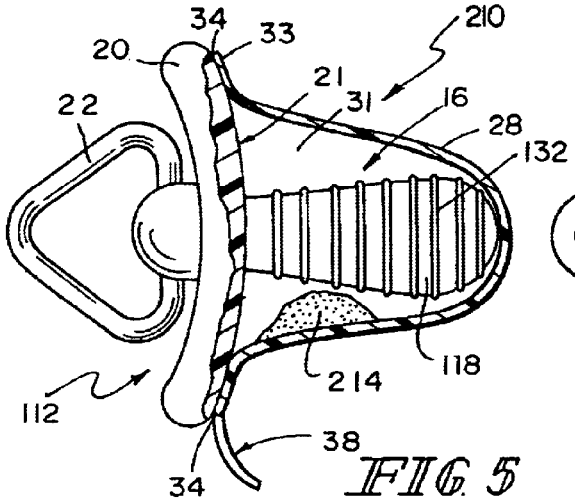
FIG. 5 is a side view with portions broken away of an embodiment of the invention wherein the carrier portion is contained within a removable sterile container.
Figure 6:
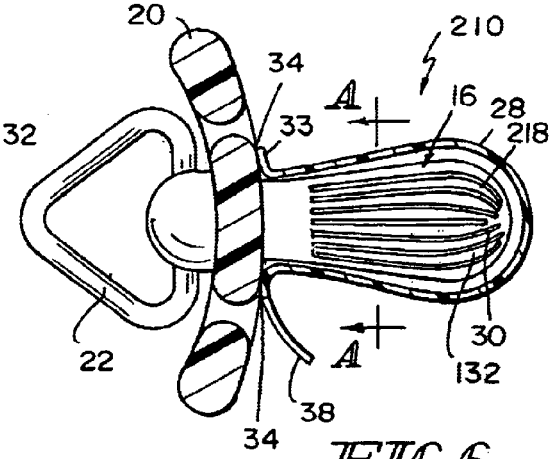
FIG. 6 is similar to FIG. 5 showing still another embodiment of the invention.
Figure 6A:
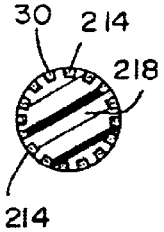
FIG. 6A is a cross-sectional view of the carrier portion of the device shown in FIG. 6.

FIGS. 5–8 illustrate alternative embodiments of the ready-to-use diversion device of the present invention. With reference to FIGS. 5 and 6, sensory diversion device 210 is manufactured to have a sweetener carrier portion 16 in the form of a nipple 118 having a high profile outer surface 132 which works to provide a high surface area for carrying sweetener composition 214 during use of the device 210. Sensory diversion device 210 is constructed in the form of a pacifier having handle portion 22, carrier portion 16 in the form of a nipple 118 with a high profile surface 132 and an intermediate safety flange 20. The carrier portion 16 is sealed in a compartment 31 defined in part by the surface 21 of flange 20 and packaging material 28 having edges 33 contacting surface 21 of flange 20 at seal 34. Edge 33 of packaging material 28 is extended at least one point to form pull tab 38 that can be grasped by the user to remove packaging material 28 from flange surface 21 by breaking seal 34 immediately prior to use of pacifier 112. Sweetener composition 214, typically in the form of a sterilized sweetener containing food acceptable gel composition is located in compartment 31 during manufacture/packaging of the sensory diversion device 210. Preferably, packaging material 28 is a flexible, transparent polymeric material, optionally a laminate of multiple polymer sheets, which the user can manipulate and deform to transfer sweetener composition 214 to the high profile surface 132 of nipple 118 immediately before removing packaging material 28 from surface 21 of flange 20.

FIG. 6 illustrates another embodiment of the present invention similar to that shown in FIG. 5 except that the carrier portion is formed as a solid nipple 218 having channels 30 that are loaded with a sweetener containing solid or gel composition 214. The sensory diversion device 210 illustrated in FIGS. 5 and 6 can be either manufactured under sterile conditions or is sterilized post-manufacture/post-packaging.

Figure 7:
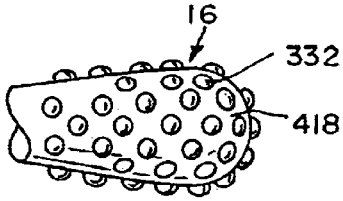
FIGS. 7 and 8 show alternative configurations of the carrier portion of the pacifier device of the present invention.
Figure 8:
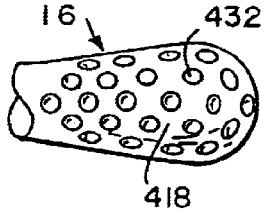

FIGS. 7 and 8 illustrate alternative embodiments of the flexible carrier portion in the form of a nipple 418 having a high profile surface 332/432 to provide high surface area for carrying a sweetener composition during device use for sensory diversion.

Figure 10:
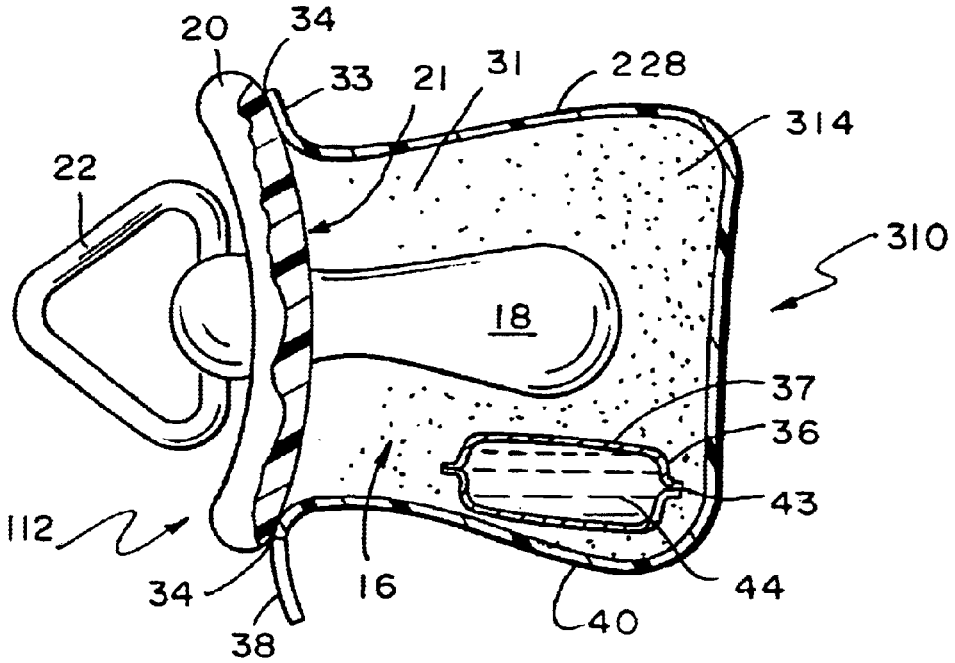
FIG. 10 illustrates an embodiment of the invention, partially broken away, wherein a user-breachable solution package is contained with powdered sucrose in a sterile envelope also containing the carrier portion of the device.
Figure 11:
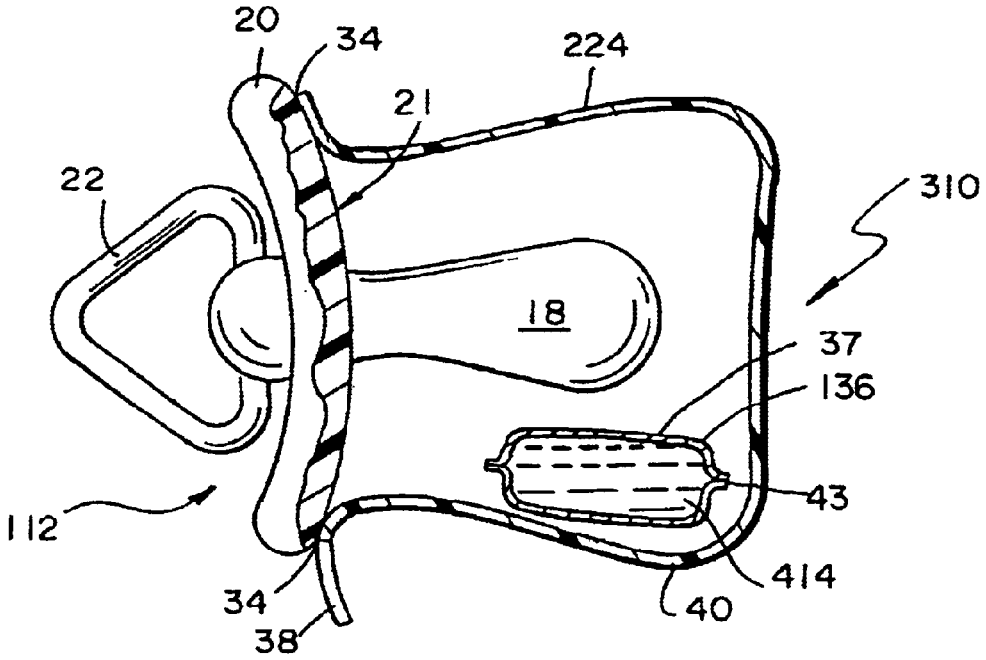
FIG. 11 is similar to FIG. 10 except the user-breachable package contains a sucrose solution or gel for release in the sterile package for coating the carrier portion of the device.

FIGS. 10 and 11 illustrate alternative embodiments of the sterile packaged ready-to-use sensory diversion device of the present invention similar to that illustrated in FIG. 5. Pacifier 112 is formed to have sweetener carrier portion 16 as nipple 18 and intermediate safety flange 20. Flexible, preferably transparent or translucent packaging material 228 is formed as a pouch 40 having edges 33 affixed to surface 21 of safety flange 20 at seal 34. Seal 34 is formed with a food-acceptable or pharmaceutical thermoplastic or thermosetting adhesive composition which will enable the formation of an airtight bond between the edges 33 of packaging material 228 and the surface 21 of safety flange 20. Pouch 40 contains sweetener composition 314 in solid (powdered) form an a user breachable package 36 of water or an aqueous gel-forming solution capable of dissolving the powdered sweetener composition 314. User breachable package 36 typically has flexible walls 37 and breachable seams or seals 43 that can be broken with application of pressure to flexible walls 37. Edge 33 of pouch 40 is extended at least at one point to provide pull tab 38 to facilitate the user's breaking of seal 34 to remove pouch 40 formed from packaging material 228 from the surface 21 of flange 20. To use the device a medical practitioner first applies sufficient pressure to flexible walls 37 of user breachable package 36 through pouch 40 to release the water into pouch 40 to dissolve sweetener composition 314 to form an aqueous sweetener mixture which is manipulated by the user by handling pouch 40 to coat nipple 18 with the resulting gel/fluid sweetener composition. Thereafter the user grasps handle 22 and pull tab 38 to remove pouch 40 of packaging material 228 from the surface 21 of the flange 20 to expose the sweetener coated nipple 18. The device can be either manufactured under sterile conditions or sterilized, for example, by incident actinic radiation, such as gamma radiation, after assembly/packaging to provide a sterilized, ready-to-use, single use sensory diversion device or oral delivery of sweeteners to infant or juvenile recipients during examination by a medical practitioner or during performance of medical procedures on the juvenile or infant patients.

Another embodiment of the invention similar to that shown in FIG. 10 is illustrated in FIG. 11. The device is essentially identical to that of FIG. 10 except that the user breachable package 136 is prepared to contain the preformulated sweetener composition as a liquid or gel that can be emptied into pouch 40 by user applied pressure and applied to nipple 18 by manipulating the packaging material used to form pouch 40 to coat nipple 18 with the sweetener composition. Thereafter the user grasps handle 22 and removes pouch 40 using pull tab 38 to break seal 34 between the edges of pouch 40 and surface 21 of safety flange 20.

Figure 12:
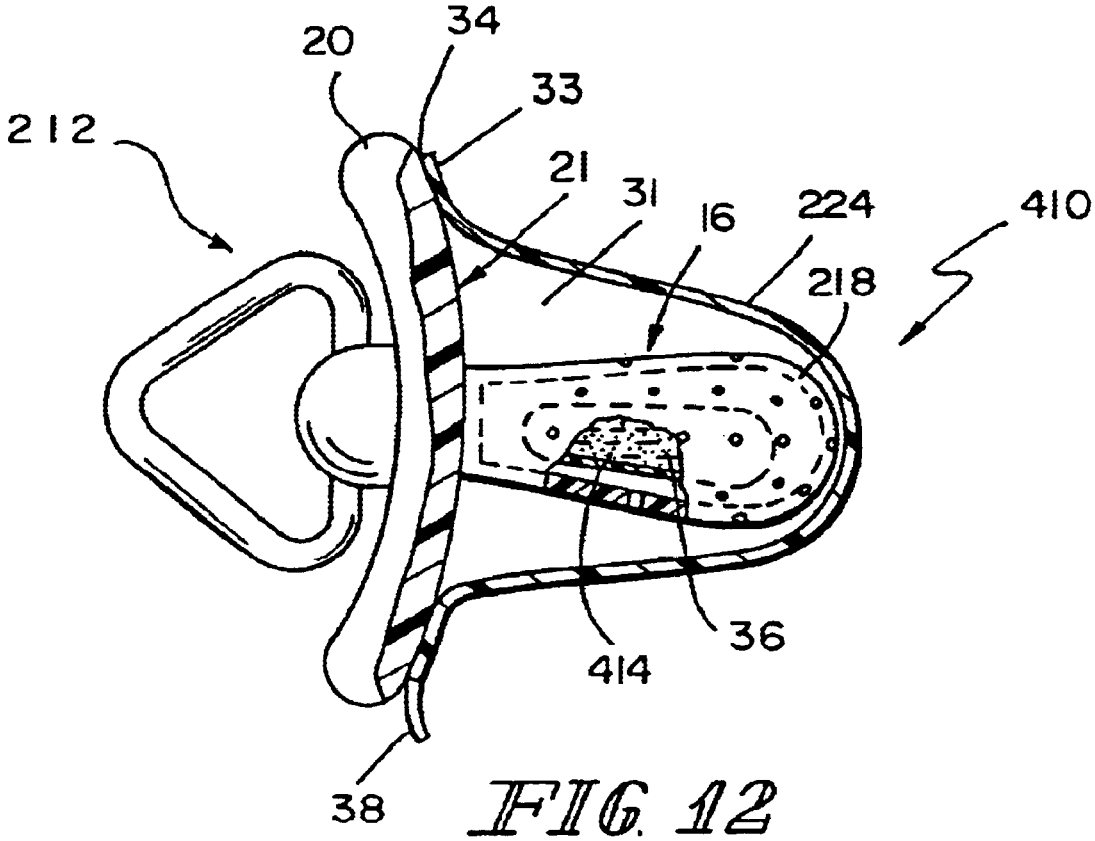
FIG. 12 is a side view partially broken away of another embodiment of the invention wherein a user-breachable package is positioned within the hollow carrier portion of the device.

Still another embodiment of the invention is illustrated in FIG. 12 wherein the sensory diversion device is formed as a pacifier 212 having a perforated hollow nipple 218. A user breachable package 136 of sweetener composition 414 is positioned is nipple 218 during device manufacture. The device is packaged by forming a compartment 31 defined by the surface 21 of safety flange 20 and flexible packaging material 224 having edges bonded to surface 21 of flange 20 at seal 34. Packaging material at 224 is typically a transparent or translucent polymer film or polymer film laminate capable of providing a barrier to maintain sterility of the perforated nipple 218 and surface 21 of safety flange 20 during shipping, storage and handling of the device prior to end use. The ready-to-use, single use sensory diversion device 410 illustrated in FIG. 12 can be used by a medical practitioner during the course of examination and performance of medical procedures on infant and juvenile patients. The device is made ready for use by applying sufficient pressure to packaging material 224 and perforated nipple 218 to open user-breachable package 36 inside perforated nipple 218 to release sweetener composition 414. Thereafter the medical practitioner simply grasps handle 22 and pull tab 38 to break seal 34 and remove packaging material 224 from surface 21 of safety flange 20. The device can be manufactured under sterile conditions or it can be sterilized after device manufacturing and packaging, preferably by use of incident actinic radiation at an intensity and for a period of time sufficient to sterilize all device components.

While the present invention has been described with reference to the illustrated embodiments, skilled practitioners will recognize that the features of the present invention can be adapted to other forms and configuration within the scope of the present invention. The illustrations are for exemplification only and are not intended to limit the scope of the invention described and claimed in the present application.

What is claimed is:

1. A ready-to-use sensory diversion device for oral delivery of sweeteners to infant or juvenile recipients, the device comprising a pacifier including a flexible carrier portion, a handle portion, and a safety flange between the handle portion and the carrier portion, at least the flexible carrier portion of said pacifier sealed in a sterile package, and a sterile composition comprising a sweetener for coating the carrier portion, wherein the carrier portion is formed to have a high profile surface.

2. The device of claim 1 wherein the package includes a tab portion to be grasped by the user to facilitate removal of the package from the device.

3. The device of claim 1 wherein the sweetener comprises sucrose.

4. The device of claim 1 wherein the sweetener comprises fructose.

5. The device of claim 1 wherein the flexible carrier portion is perforated.

6. The device of claim 1 wherein the sweetener composition is contained in a separate user disruptible package.

7. The device of claim 6 wherein the user disruptible package is positioned within the sterile package.

8. The device of claim 1 wherein the sterile sweetener composition is sealed in the package with at least the flexible carrier portion of the pacifier device.

9. The device of claim 8 wherein the sweetener composition is in a liquid or gel form.

10. The device of claim 9 wherein the sweetener composition is in a separate user disruptible package.

11. The device of claim 8 wherein the sweetener is in a solid form.

12. The device of claim 8 further comprising water in a user disruptible package positioned within the sterile package.

13. The device of claim 8 wherein the sweetener composition is coated onto the surface of the flexible carrier portion.

14. The device of claim 1 wherein the package sealing at least the flexible carrier portion of the device also contains the sweetener composition in solid form and a sealed user breachable package containing a water solution.

15. A ready-to-use sensory diversion device for oral delivery of sweeteners to infant or juvenile recipients, the device comprising a pacifier including a flexible carrier portion, a handle portion, and a safety flange between the handle portion and the carrier portion, at least the flexible carrier portion of said pacifier sealed in a sterile package, and a sterile composition comprising a sweetener for coating the carrier portion, wherein the sweetener composition is contained in a separate user disruptible package and the user disruptible package is positioned within the sterile package.

16. The device of claim 15 wherein the sweetener composition is in a liquid or gel form.

17. A ready-to-use sensory diversion device for oral delivery of sweeteners to infant or juvenile recipients, the device comprising a pacifier including a flexible carrier portion, a handle portion, and a safety flange between the handle portion and the carrier portion, at least the flexible carrier portion of said pacifier sealed in a sterile package, and a sterile composition comprising a sweetener for coating the carrier portion, wherein the sterile sweetener composition is sealed in the package with at least the flexible carrier portion of the pacifier device, wherein the sweetener is in a solid form, and further comprising water in a user disruptible package positioned within the sterile package.

18. A ready-to-use sensory diversion device for oral delivery of sweeteners to infant or juvenile recipients, the device comprising a pacifier including a flexible carrier portion, a handle portion, and a safety flange between the handle portion and the carrier portion, at least the flexible carrier portion of said pacifier sealed in a sterile package, and a sterile composition comprising a sweetener for coating the carrier portion, wherein the package sealing at least the flexible carrier portion of the device also contains the sweetener composition in solid form and a sealed user breachable package containing a water solution.

* * * * *